United States Patent [19]

Herdies

[11] Patent Number: 4,953,601

[45] Date of Patent: Sep. 4, 1990

[54] TRANSFORMABLE TOOL-BOX

[76] Inventor: Julien Herdies, Archennes, Belgium

[21] Appl. No.: 353,646

[22] PCT Filed: Jun. 25, 1987

[86] PCT No.: PCT/BE87/00010

§ 371 Date: Apr. 10, 1989

§ 102(e) Date: Apr. 10, 1989

[87] PCT Pub. No.: WO88/10176

PCT Pub. Date: Dec. 29, 1988

[51] Int. Cl.[5] ..... B25H 3/02; B25H 1/12

[52] U.S. Cl. ..... 144/285; 144/286 A; 312/DIG. 33; 312/247; 312/306

[58] Field of Search ..... 312/DIG. 33, 235, 306, 312/247; 144/1 R, 285 R, 286 R, 286 A

[56] References Cited

U.S. PATENT DOCUMENTS

| | | | |
|---|---|---|---|
| 477,509 | 6/1892 | Chase | 144/285 |
| 742,118 | 10/1903 | Huddleston | 144/285 |
| 1,074,932 | 10/1913 | Dickenson | 144/285 |
| 1,459,930 | 6/1923 | Riehle | 144/285 |
| 4,338,987 | 7/1982 | Miles | 144/285 |
| 4,733,703 | 3/1988 | Cimino | 144/285 |

*Primary Examiner*—W. Donald Bray

*Attorney, Agent, or Firm*—Hayes, Soloway, Hennessey & Hage

[57] ABSTRACT

Tool-box (1) comprised of a female box (50) and a male box (10) which is retractable in the female box (50) or which may be rigidly set on the female box so as to form a workbench and/or a step-ladder. The male box (10) comprises two series (15, 16) of drawers (17) and, between those two series (15, 16), a tiltable and removable tray (20) having two compartments (25, 26). The tray (20) may be tilted on one side up to a stop and may be removed on the other side.

12 Claims, 5 Drawing Sheets

TRANSFORMABLE TOOL-BOX

The present invention relates to a tool-box which can be transformed into a workbench and which can likewise serve as a step-ladder.

The document No. BE-A-903,860 has disclosed a tool-box of the abovementioned type which comprises a male box and a female box, in which the male box is arranged in a sliding manner, the female box is provided with two open-worked opposite walls possessing a bottom case and, on the other two opposite walls, interior guide grooves and ribs, the male box provided with two openworked walls opposite walls being provided on two opposite walls with exterior guide grooves and ribs capable of engaging in the guide grooves and ribs of the female box in one position of the male box relative to the female box, the said guide ribs and grooves being arranged in a manner such that, in a position offset by 180° relative to the previous position, the male box bears on the corresponding walls of the female box, the said male box further comprising two lateral series of drawers arranged one under the other, at a distance from one another, together with a working surface forming the top wall of the male box and the lid of the tool-box in the closed state.

The bottom case of the female box advantageously projects slightly beyond the female box and can thus serve as a bottom step of a step-ladder, the base of the male box placed on the female box being capable of serving as a second step and the working surface as a third step.

The object of the present invention is to provide an improved tool-box of the abovementioned type.

According to the present invention, the male box comprises, in the space contained between the two lateral series of drawers, a tiltable and removable tray equipped with at least two means forming a tilting hinge on the base of the male box, arranged on two opposite sides, the said tiltable and removable tray being tiltable towards one side, up to a stop, and towards the other side until it can be retracted from the male box.

Preferably, the removable and tiltable tray is provided with at least two feet arranged on two opposite sides and assuming the shape of a rib which is arranged in a manner such as to engage into corresponding grooves made in the base of the said male box.

Advantageously, the tiltable and removable tray comprises four opposite feet, in pairs, which assume the shape of a rib engagable in corresponding grooves made in the base of the male box, in a manner such as to form two opposite tilting hinges.

According to a preferred embodiment, the stop forming the check on tilting towards one side is arranged on the inner surface of the top wall of the male box. By virtue of this check, the user can tilt said tray to withdraw therefrom the tools which he requires without the tray tilting completely and moving out of its seating. On the other side, the user can tilt the tray and retract it from its seating without being inconvenienced by a checking stop, with a view to taking the tray with him. Advantageously, said tiltable and removable tray comprises two perforations in which the clasps of a strap can be inserted. In this manner, the user can suspend said tray from his shoulder. The strap is advantageously a strap which likewise serves to carry the tool-box in the closed state, with the aid of suitable locking members.

Preferably, the said tiltable and removable tray comprises at least two compartments. It can likewise be provided on at least one of its front and rear faces with a handle or with a notch in said face acting as a handle.

The invention is described in more detail below with the aid of the figures, wherein.

With reference to the Figures, identical reference marks represent identical or similar elements.

Figure 1:
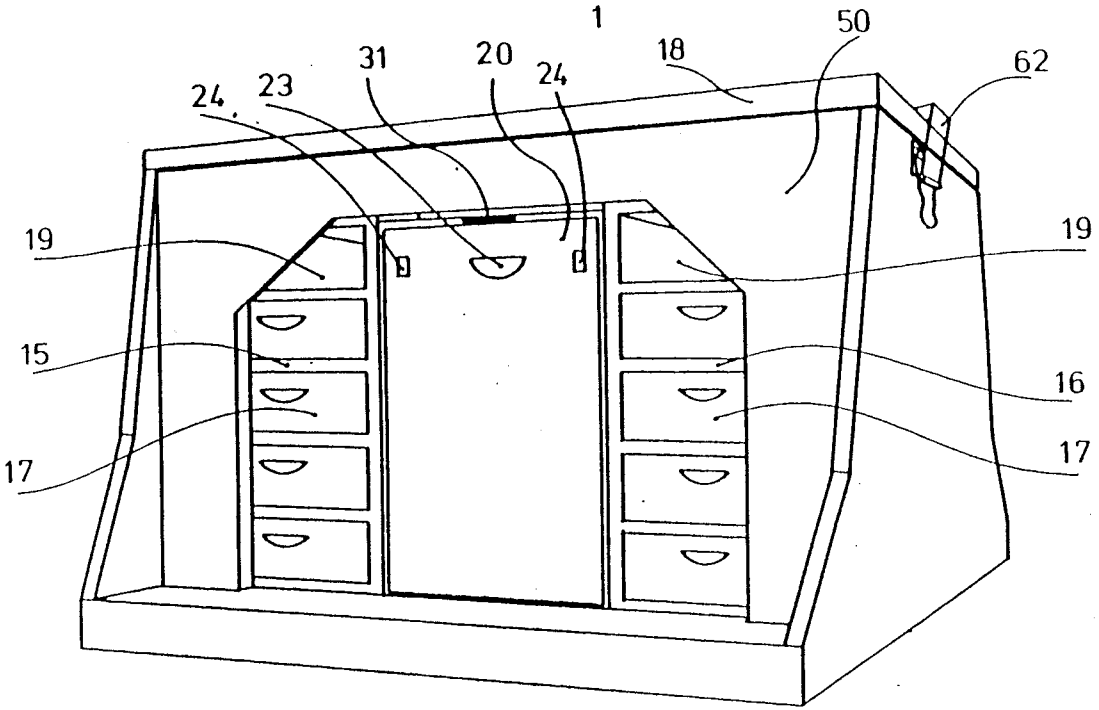
FIG. 1 is a perspective view of the tool-box in the closed state.

In FIG. 1, the tool-box 1 according to the present invention has been shown in the closed state, that is to say with the male box 10 introduced into the female box 50.

Figure 4:
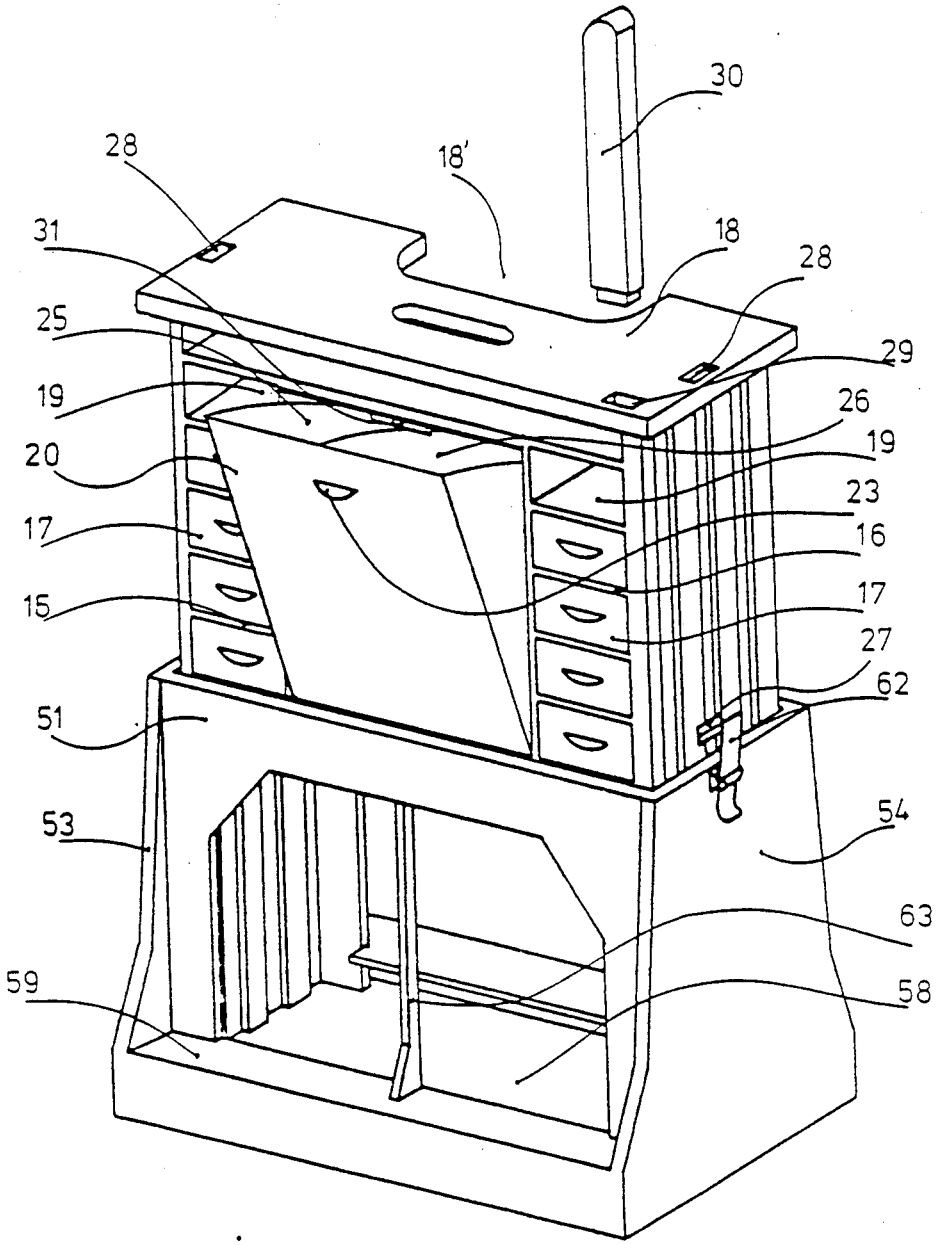
FIG. 4 is a perspective view of the tool-box in the open state, the tray being tilted.

In FIG. 4, on the other hand, the tool-box is shown in the open state, mainly with the male box placed on the female box.

Figure 2:
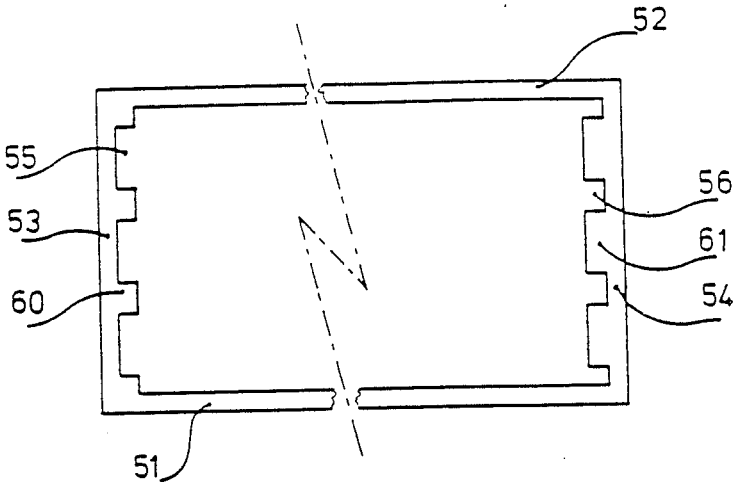
FIG. 2 is a view in section in the plane A—A of the female box.
Figure 3:
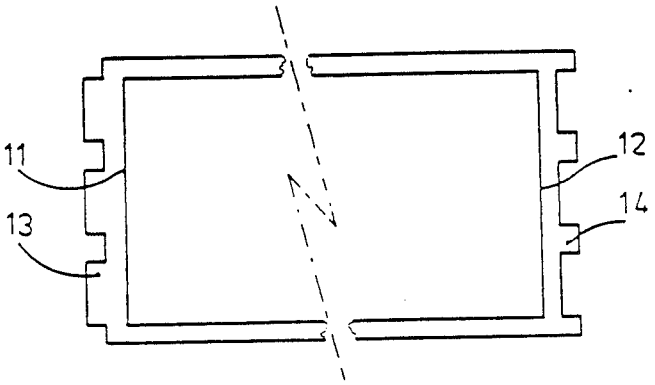
FIG. 3 is a view in section in the plane A—A of the male box.

The female box 50 possesses an essentially parallelipipedal shape whose front 51 and rear 52 faces are open-worked and whose opposing lateral faces 53, 54 possess guide grooves 55 and 56, as shown in FIG. 2. Moreover the female box 50 possesses, in its lower part, a case 58 intended to receive heavy tools such as a heavy-duty drill, a keyhole saw, etc... The case 58 advantageously projects beyond the front 51 and rear 52 faces in order to widen the base of the tool-box to give it greater stability and in order to form a step of a step-ladder 59.

The male box 10 likewise possesses an essentially parallelipipedal shape and is so designed as to be able to slide into the female box so as to retract into the latter as far as the level of the case 58. On two opposite lateral faces 11 and 12, it possesses guide ribs 13 and 14 which can engage into the corresponding grooves 55 and 56 of the female box 50 in one position of the male box 10 relative to the said female box 50.

The grooves 55 and 56 and also the ribs 13 and 14 are designed in the manner such that, in one position of the male box 10 relative to the female box 10, in which the male box 10 is offset by an angle of rotation of 180° about a vertical axis relative to the position in which it engages into the female box 50, said male box 10 no longer engages into said female box 50 but rests thereon. In this case the ribs 13 and 14 of the male box 10 rest on the projecting parts 60 and 61 of the female box. It is likewise possible to provide similar devices on the front and rear faces of the male and female boxes with a view to ensuring a good seat of the male box on the female box.

The male box 10 likewise possesses two lateral series 15 and 16 of drawers 17 arranged one below the other, the two series 15 and 16 being at a distance from one another. The upper face of the male box constitutes the working surface 18 of a workbench and, when the male box is retracted into the female box 50, the lid of the tool-box. It can likewise serve as the last step in a step-ladder.

Advantageously, the working surface 18 is fitted with a retractable handle or an aperture 19 allowing the passage of a hand, which facilitates transportation of said tool-box according to the present invention. Said working surface 18 can likewise possess a notch 18' which facilitates access to the last step when it is used as a step-ladder.

In the upper part of each series of drawers 15 or 16 is provided an empty position 19 intended to facilitate the installation of a vise or of a clamp, for example.

Figure 5:
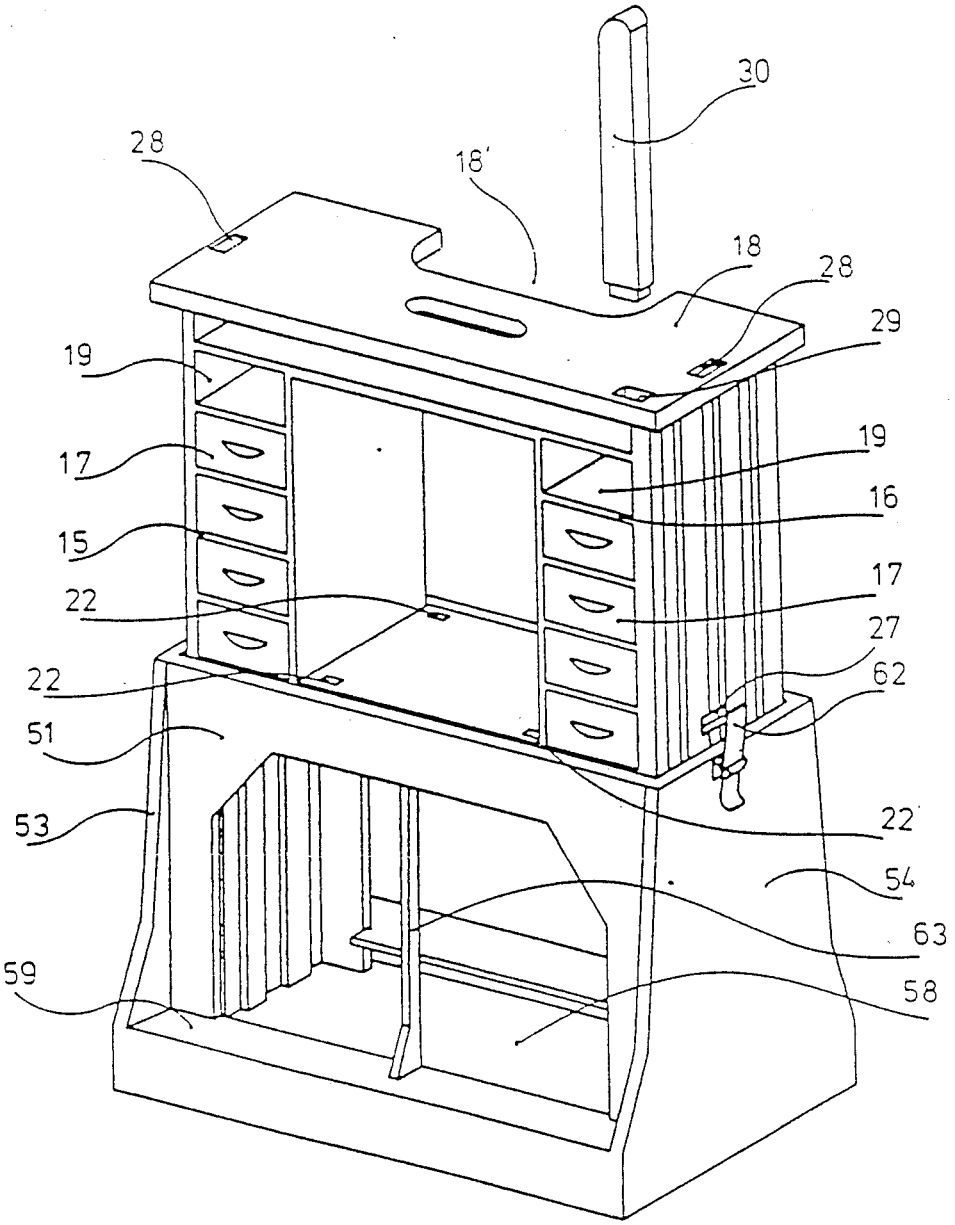
FIG. 5 is a perspective view in accordance with FIG. 4, in which the tray is retracted.
Figure 6:
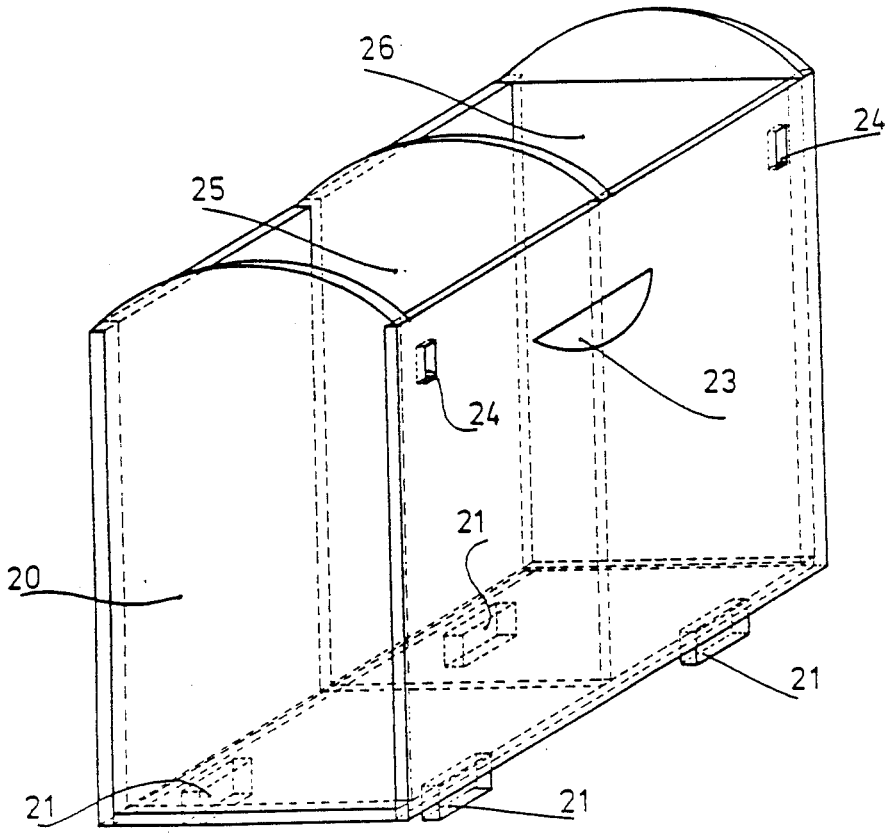
FIG. 6 is a perspective view of the tiltable tray.

According to the present invention, the male box 10 possesses, in the spacing comprised between the two sets of drawers 15 and 16, a removable and tiltable tray 20. The latter is shown in detail in FIG. 6. It is fitted with four opposing feet 21, in pairs, which engage into corresponding grooves 22 (FIG. 5) made in the base of said male box 10. The rib-shaped feet 21 and the corresponding grooves 22 are arranged in a manner such as to form two opposing tilting hinges, arranged on the front face and on the rear face of the tool-box.

While working, the user can readily tilt the removable tray 20 on a hinge 21–22, taking it by an appropriate handle or an aperture 23, to withdraw therefrom a tool which is placed therein. Advantageously, said tipping is blocked, on the side of the front face, by a stop 31 provided on the inner face of the working surface 18. On the other hand, if the user intends to move away from his workbench to carry out a job, he can remove the tray 20 via the rear of the male box 10 and take the tray 20 with him.

Advantageously, said removable and tippable tray 20 is provided with two perforations 24 into which can be introduced clasps fixed to the ends of a strap, in a manner such that said tray 20 can be suspended, for example, from the user's shoulder. Said strap (not shown) can likewise be used for carrying the tool-box in the closed state, for example by hooking it to rings or similar means fixed to the female box 50.

According to a preferred embodiment, the tray 20 comprises two compartments 25 and 26 for the storage of tools or other articles.

With a view to ensuring good stability of the whole, particularly in the open state, the female box can be fitted with two or more rapid fastening devices 62 (for example tailpieces or box clasps) which can engage in the notches 27 made in the male box 10. These rapid fastening means 62 can likewise fix the whole in the closed state by engag-ing in notches 28 made in the working surface 18.

Advantageously, the working surface 18 can also comprise a slot 29 intended to receive a hand support 30 which is preferably removable and is intended to provide a support point when the whole is being used as a stepladder.

The tool-box according to the present invention can be composed of various materials, as for example a plastic such as PVC.

As a function of the material selected, it may be expedient to provide a reinforcement 63, particularly at the back of the female box.

It is clear that the present invention is not restricted to the preferred embodiment described but extends to the scope defined by the claims.

I claim:

1. A tool box for storing tools and the like, comprising, in combination:

(a) a female enclosure open at its upper end, and having a base, a pair of side walls, and a pair of front and rear walls having openings therein;

(b) a male box assembly vertically slidably mounted in said female enclosure between a first position and a second position, said male box assembly comprising a pair of side walls, a base and a top horizontal work surface, and a plurality of slidably mounted drawers located in two spaced vertical columns on opposite sides within said male box assembly and defining a cavity therebetween;

(c) locking means for securing said male box assembly in said first position within said female enclosure; and (d) an outwardly pivotally mounted tool tray carried within said male box assembly in the cavity between the said vertical columns of drawers.

2. A tool box as claimed in claim 1, and further comprising vertical support means comprising a plurality of complementary vertical guide members located respectively on facing side walls of said female enclosure and said male box assembly, said male box assembly being horizontally offsettable relative to said female enclosure in said second position, whereby the guide members of said male box assembly may be seated upon the top edge surfaces of the guide members of said female enclosure, and locking means for holding said male box assembly in place while seated on top of said female enclosure.

3. A tool box as claimed in claim 1, and including a horizontal extension on the lower portion of the female enclosure whereby to form a first step; a second step formed by the base of said male box assembly, and accessible by removal of said tool tray from within said male box assembly; and a third step formed by the top horizontal work surface of said male box.

4. A tool box as claimed in claim 3, and further including:

(a) a vertically positioned support pole member to lend support to a person using said steps, said support pole member being removably mountable in a matching recess in the top horizontal work surface of said male box assembly; and (b) a cutout in the top horizontal work surface of said male box for facilitating access to said third step.

5. A tool box as claimed in claim 1, wherein said tool tray is mounted within said male box assembly such that the tray is tiltable in one direction to provide access to an opening in the top of said tray, and removable from said male box assembly when tilted in the opposite direction.

6. A tool box as claimed in claim 1, and including perforations in the sides of said tool tray for receiving a carrying strap.

7. A tool box as claimed in claim 5, and including a stop forming a tilting check towards one side arranged on the inner face of the top wall of the male box assembly.

8. A tool box as claimed in claim 5, and including two perforations in the side walls of said tray for the introduction of end hooks of a strap.

9. A tool box as claimed in claim 5, and including a handle or an aperture in a wall of said tray sized to accommodate a human hand.

10. A tool box as claimed in claim 5, wherein said tray is divided into at least two compartments.

11. A tool box as claimed in claim 1, and comprising two or more rapid fastening devices mounted on the side walls of said female enclosure for engaging with notches formed in the top horizontal surface of said male box assembly.

12. A tool box as claimed in claim 1, and including a slot sized to accommodate a human hand formed in the top horizontal surface of said male box assembly.

* * * * *